United States Patent [19]

Bemthin

[11] 4,094,018

[45] June 13, 1978

[54] BOTTOM DOUCHE FOR FLUSH TOILETS

[75] Inventor: Johannes Bemthin, Bremerhaven, Germany

[73] Assignee: MFB Neuwerk GmbH, Bremerhaven, Germany

[21] Appl. No.: 646,666

[22] Filed: Jan. 5, 1976

[30] Foreign Application Priority Data

Jan. 7, 1975 Germany ..... 2500345

[51] Int. Cl.[2] ..... E03D 9/08

[52] U.S. Cl. ..... 4/7; 74/32

[58] Field of Search ..... 4/1, 6, 7; 128/227, 128/229; 74/29-32, 422

[56] References Cited

U.S. PATENT DOCUMENTS

| | | | |
|---|---|---|---|
| 1,886,920 | 11/1932 | Thomas | 4/7 |
| 1,935,201 | 11/1933 | Callejo | 4/7 |
| 2,774,078 | 12/1956 | Pazos | 4/7 |
| 2,852,782 | 9/1958 | Sundberg | 4/7 |
| 2,957,180 | 10/1960 | McMullen | 4/7 |
| 3,781,919 | 1/1974 | Ayala | 4/7 |
| 3,925,826 | 12/1975 | Huyot | 4/7 |

FOREIGN PATENT DOCUMENTS

| | | | |
|---|---|---|---|
| 699,948 | 12/1930 | France | 4/7 |

*Primary Examiner*—Richard E. Aegerter
*Assistant Examiner*—Stuart S. Levy
*Attorney, Agent, or Firm*—Michael J. Striker

[57] ABSTRACT

A bottom douche for flush toilets comprises arms supported with one end on the toilet; spray nozzles carried at the free ends of said arms; duct means for passing water through said arms to said nozzles; a handle associated with the toilet, and a linkage connecting said handle and said arms for swiveling said arms and nozzles about a generally horizontal axis extending transversal to the seat of the toilet and for shifting the arms in a direction about parallel to seat so as to bring the nozzles into spray position.

13 Claims, 11 Drawing Figures

FIG. 4
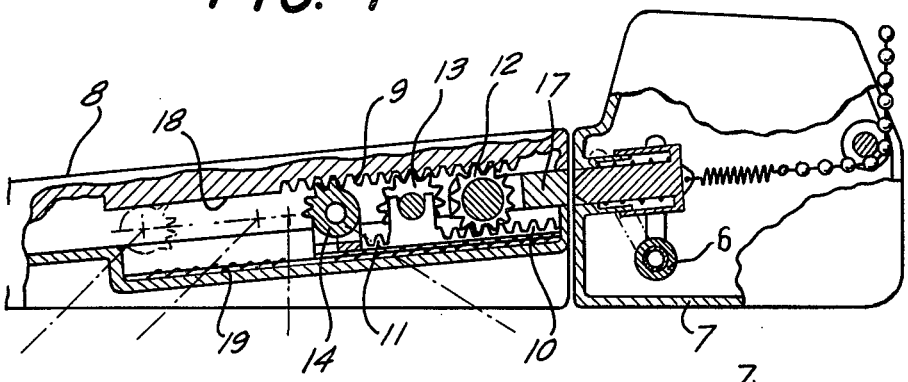
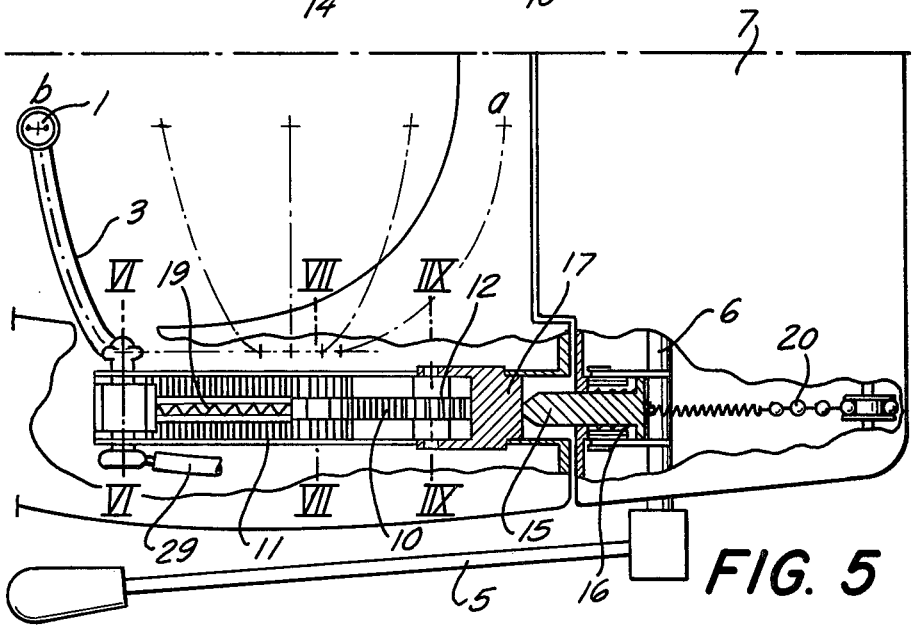
FIG. 5
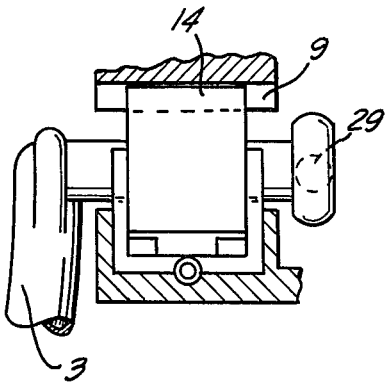
FIG. 6
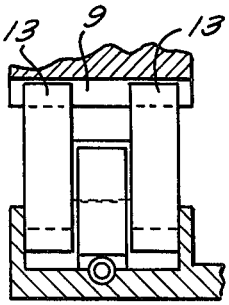
FIG. 7
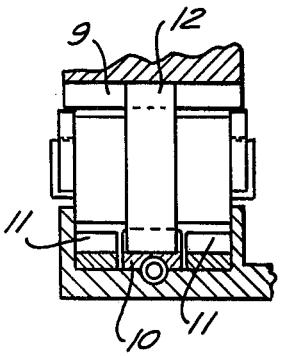
FIG. 8

BOTTOM DOUCHE FOR FLUSH TOILETS

BACKGROUND OF THE INVENTION

The invention relates to a bottom douche for flush toilets.

Well known are bidets for the anal hygiene in which heated water is passed into stationary spray nozzles. Bidets, however, are comparatively seldom found in toilets and only at places with rather elevated standards of hygiene. Usually they are installed next to the conventional toilet.

Flush toilets are also known in which after use a bottom douche is provided for cleaning the buttocks of the person using the toilet. This bottom douche is in addition to the flush installation for cleaning the toilet bowl and removing the accumulation from the bowl into the sewer.

This kind of installation is frequently considered as a combination of a toilet and a bidet. The majority of the known installations provides for a stationary spray douche where the axis of spray is directed against the anus of the person sitting on the toilet. Usually, this spray is arranged in the rear portion of the toilet to prevent soiling below the flange of the toilet. This spray douche is fed after each use with lukewarm water at a low pressure. The water can be prepared in a heating or mixing vessel. To keep a supply of lukewarm water is usually advantageous. The actuation of the spray nozzle which is useful only for washing in the anal area may be effected by means of a foot lever, a hand lever or, for instance, pressure keys which can be reached with the elbow in the sitting position; see German published application 1,907,208.

To better protect the spray nozzle it has been known to provide the nozzle for horizontal shifting so that it is in a position protected against soiling during the time of use of the toilet and from this position can be shifted into the spray position proper. This may be effected by a lever which may also activate the water supply to the nozzle, see U.S. Pat. No. 2,504,257, German published application 1,759,098 and German Pat. No. 1,129,896.

An about equal effect is accomplished in another installation by a swivelling spray nozzle where the spray nozzle can be swivelled out of the position where it is protected against soiling during actual use of the toilet. This swivelling may be effected about a vertical axis, see German published application 1,955,075 or about a horizontal axis, see German published application 2,325,260 and German utility model 1,961,098. The advantage of the movable installation of the spray nozzle is that the outlet of the nozzle can be moved closer to the anus of the person using the toilet.

Another prior art contemplates several spring nozzles arranged in the form of a ring which likewise are pointed centrally towards the anus of the person.

All of the aforementioned devices have already been connected with the toilet seat. This requires in some of the cases large, and not usually acceptable, dimensions for the seat. Also the use of special accessories which can be installed in a toilet seat already present has become known.

A separate concept of the prior art devices provides for the additional use of a hot air blower for drying the wet parts of the body after using the bottom douche.

A shortcoming of all these described bottom douches is that the spray from the nozzle is directed to a point-shaped specific place, that is, the anus of the person using the toilet. Experiences with these prior art devices have shown that with this kind of device the soil adhering in the anal area to the body is only splashed apart and not rinsed away. In addition, particularly in case of older persons, transpiration accumulates in the buttocks fold below and above the anus which, with the conventional toilet paper use, is easily removed. With female persons there is an increased desire more frequently to clean the anal area including the outlet of the urethra. Under this viewpoint the use of the conventional toilet paper is actually better than the described nozzle sprays. Thus, the use of the prior sprays does not give rise to the sensation of a hygienically perfect cleaning which is believed is the main reason that this kind of douche has not been accepted by larger parts of the population.

It is therefore an object of the invention to improve the flush action of a nozzle spray used in a bottom douche for flush toilets and to accomplish the cleaning of a larger body area.

SUMMARY OF THE INVENTION

This is accomplished by a bottom douche which comprises arms supported with one end on the toilet; spray nozzles carried at the free ends of said arms; duct means for passing water through said arms to said nozzles; a handle associated with the toilet, and a linkage connecting said handle and said arms for swivelling said arms and nozzles about a generally horizontal axis extending transversal to the seat of the toilet and for shifting the arms in a direction about parallel to said seat so as to bring the nozzles into spray position.

BRIEF DESCRIPTION OF THE DRAWING

FIG. 4 is a vertical longitudinal section through a rack-and-pinion drive arranged in the toilet seat and shown in the position of rest and at a scale enlarged against that of FIGS. 1 to 3;

FIG. 5 is a plan view of the rack-and-pinion drive of FIG. 4 showing the drive in the final position, that is, the active spray position;

FIGS. 6, 7 and 8 are cross-sections through the device as shown in FIG. 5 and at an enlarged scale along lines IV to IV, VII to VII and VIII to VIII, respectively;

DISCUSSION OF THE INVENTION AND OF PREFERRED EMBODIMENTS

Figure 1:
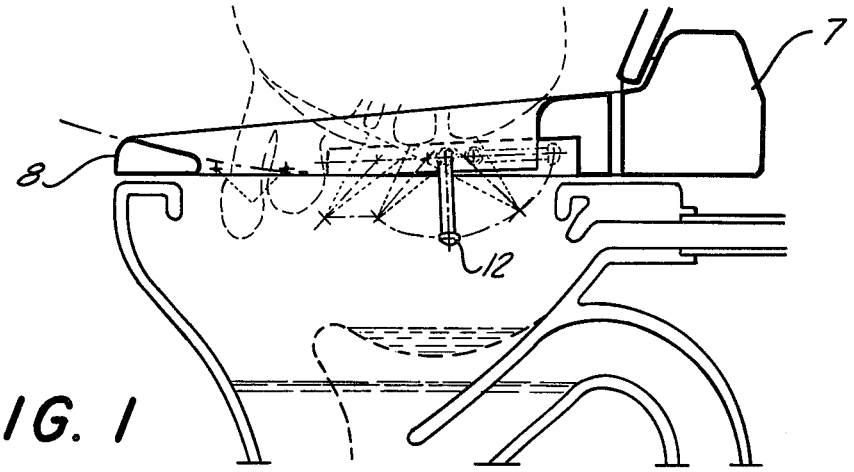
FIG. 1 is a vertical longitudinal section through a toilet seat provided with a bottom douche of the invention.

As appears from the above summary, the nozzle sprays of the invention are arranged for swivelling about a horizontal axis transversal to the toilet seat during spray action and for shifting in a direction parallel to the toilet seat. According to an important concept of the invention this movement of the nozzle sprays should bring the spray into action at an area from the upper end of the fold of the buttocks up to the outlet of the urea in case of a female person using the toilet and should also direct the nozzle into position for an impact on the body at a slant to the body surface.

In this manner a flush effect of the water spray is obtained as it is well known from a slanted impact of a water spray onto a surface. This flush effect avoids the splashing apart of the soil adhering to the body and results in a flush removing the soil from the body. Besides, the soil predominantly adhering to the outer part of the closure muscle of the anus is removed with a kind of massage effect as it is also obtained with use of paper and generally provides a better cleaning effect. With the stationary spray nozzles of the prior art, this could not be accomplished.

Furthermore, it is an important fact that the flush and cleansing effect can be exercized in regard to all body surfaces exposed to soiling in the anal area. A person using the toilet therefore does not only obtain cleanliness in the anal area, but will also have a pleasant sensation due to this cleanliness.

It is in particular important that the spray nozzles can be swivelled from both sides until they have positions of impact for the water spray at at least a 45° angle to the body surface. This swivelling is effected about a horizontal axis transversal to the toilet seat. For this purpose the nozzles are slanted towards the center of the toilet and in an upward direction. Thus, first the coarse soil accumulated at the anus is flushed away and later a thorough cleaning of the entire desirable area is effected.

An important feature of the invention is also that the two nozzles which are arranged at spaced points in a direction across or transversal to the toilet seat can in a first period of time, be swivelled from the rear to the front during the spray operation and can thereafter be shifted in a straight horizontal direction. As a result the water sprays are directed at a slant against each other and they will remove and flush out the soiling towards the center of the toilet. This effect is further supported by the 90° setoff and lever actuated and modifiable slant position of the nozzles.

The use of two spray nozzles arranged at a distance transversal to the toilet seat has also the advantage that the water spray is no longer directed against delicate parts of the body and in particular the nozzles can be caused to pass by the sex part of male users of the toilet during the spraying action and can still effect the cleaning in a relatively large area. To fit individual requirements it is preferred to provide the movability of the nozzles only in a partial area, for instance only in the area of the anus.

For cost reasons it is preferred to provide the mechanical parts of the bottom douche in the toilet seat. This kind of installation makes also possible the subsequent mounting of the douche by merely exchanging the toilet seat. This can then be done in all kinds of toilets, irrespective of their flush system and structure.

To transmit the movement of the handle to the spray nozzles the invention contemplates the use of a rack-and-pinion drive provided in the toilet seat. This drive will convert the movement of the handle first from the starting position into a swivelling movement and thereafter into a linear about horizontal movement of the nozzles. Comparatively small movements of the handle are sufficient to move the nozzles through the entire pathway of their intended movement.

Since there are two spray nozzles used in the preferred embodiment of the invention, it is necessary to have a rack drive on each side of the toilet. The more specific elements of this rack-and-pinion drive will be discussed below. A connection between the actuation of the spray nozzle and the flushing of the toilet can easily be accomplished. Likewise, the handle can cause the actuation of the valve for the water supply to the spray nozzles.

Figure 2:
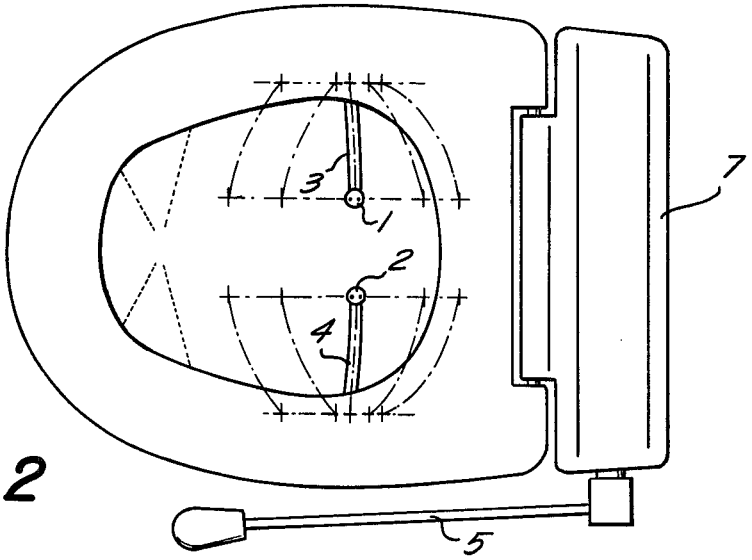
FIG. 2 is a plan view of a toilet seat of the same type as shown in FIG. 1.
Figure 3:
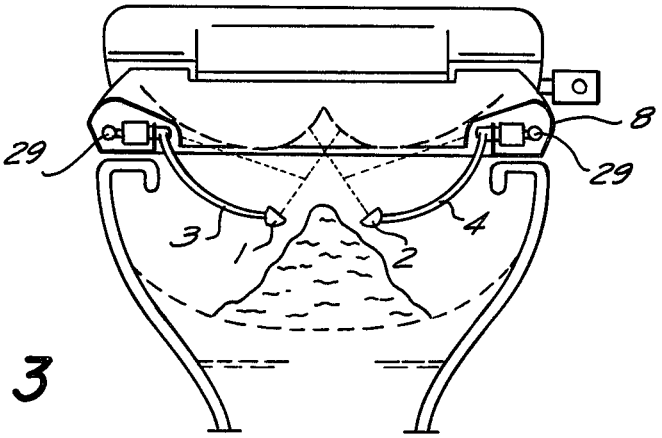
FIG. 3 is a vertical cross-section shifted by an angle of 90° against the showing in FIG. 1.

With reference now to the drawings and in the first place to FIGS. 1 to 3 it will be noted that two spray nozzles having the reference numbers 1 and 2 are arranged in spaced relationship across the toilet seat. In the following discussion the basis for the use is taken as the longitudinal direction of the view of a person using the toilet.

The spacing of the arms 1 and 2 on the basis of experiments is chosen among others so that the nozzles pass by the sex parts of a person using the toilet. They move accordingly along the dot-dash line of FIG. 2 parallel to the longitudinal line. The sprays are thus not exposed to the soiling of the bowl after use of the toilet. The axes of the outlet openings of the nozzles 1 and 2 as appears from FIG. 3 are directed at a slant upwards and towards the center. Thus, the two sprays will cross each other before impinging upon opposite parts of the buttocks of the person.

The spray nozzles 1 and 2 can also be swivelled about a horizontal axis transversely to the longitudinal direction. This swivelling can be effected to a point where the angle of impact is at least 45°.

To carry out a movement the spray nozzles 1 and 2 are mounted on arms 3 and 4 which also carry the ducts for feeding lukewarm water. The shape of the arms as appears from FIG. 3 is also done under the viewpoint that the arms 3 and 4 and the nozzles 1 and 2 must be protected against soiling during use of the toilet.

To operate the nozzles a lever 5 with a handle is provided which is mounted on a horizontal axle 6 for which the bearing is provided in the part 7 of the toilet seat.

With regard to the transmission of movement from the handle, reference is made particularly to FIGS. 4 and 5. As appears there is provided a rack-and-pinion drive, one separate rack being provided for each of the nozzles 1 and 2. These racks are arranged in the lateral wings of the toilet seat 8 and are connected by a linkage of conventional type with the support part 7.

The profile of the cross-section of the toilet seat as it appears from FIGS. 1 to 4 is determined by the necessity for installation of the parts of the bottom douche in the hollow toilet seat 8.

Each rack-and-pinion drive is formed as a rack differential drive in which a stationary rack 9 cooperates with several movable racks 10 and 11 and freely revolving pinions 12, 13 and 14 of which the teeth mesh with the teeth of the racks. The stationary racks 9 are arranged in the wall of the toilet seat 8.

The handle lever 5 acts on a plunger 15 to which is attached a spring 16. The plunger 15 in turn acts against a slide support 17 which moves parallel to the stationary rack. The slide support carries the pinion 12 which is freely rotatable in the slide support and with its teeth on one hand meshes with the teeth of the stationary rack 9 and on the other hand with the teeth of the first rack bar 10 which moves parallel to the slide support 17. Freely rotatable on the rack 10 is the pinion 13 of which the teeth mesh with the teeth of the stationary rack and at the same time also with the teeth of the second movable rack bar 11 which likewise moves parallel to the slide support 17. Freely rotatable on the second movable rack bar is the pinion 14 of which the teeth however extend only over part of the circumference. The circumference of this pinion insofar as smooth should not exceed the root line of the teeth.

Connected with the teeth of the stationary rack bar is also a slide surface 18 which extends parallel to the direction of movement of the movable rack bars 9 and 10. The pinion 14 in addition is directly connected with the arm 3 or also with the arm 4 of the spray nozzles.

The pinions which mesh both with the stationary and the movable rack bars permit to obtain in each stage of the operation a doubling of the length of movement of the movement actuated by the handle.

In FIG. 2 the range of movement of the spray nozzles is schematically indicated. For reasons of symmetry the intermediate stage with the movable rack bar 11 and the pinion 13 has been subdivided and arranged next to the rack bar 10 and pinion 12.

A screw spring 19 is disposed parallel to the direction of movement of the rack bars 10 and 11. It is attached at one end to the toilet seat and with the other end embraces the circumference of the pinion 14 on the portion which is formed smooth. The plunger 15 together with the spring 16 will permit the movement transmission to be subdivided from the handle to the nozzles at the place of separation between the swingable part 8 and the stationary part 7.

The device is operated as follows:

The handle lever is moved into the position of rest by the screw spring 19 which acts on the rack-and-pinion drive as shown in FIG. 4. When the lever is now moved out of the position of rest the teeth at first roll on each other which causes a rapid lengthening of the path of the movement. The nozzle is thus swivelled from position *a* as shown in FIG. 5 until the teeth of the pinion 14 move onto the slide surface 18 at the end of the teeth of the rack bar 9. The pinion now slides without revolving on the slide surface 18. Thus, the swivel movement is stopped and a linear movement of the nozzle is started in the direction of the shifting of the rack bars. During this period the screw spring 19 holds the nozzle 1 in its position since it exerts a rotary moment on the pinion 14 contrary to the initial swivel movement.

The terminal position *b* is likewise indicated in FIG. 5. In this position the rack-and-pinion drive is pulled across from the position in FIG. 4 to the position in FIG. 5. The range of movement of nozzles 1 and 2 from position *a* to position *b* is sufficient to cause the spray to cover the area from the upper rear end of the fold of the buttocks up to the outlet of the urethra of a female using the toilet.

A simultaneous activation of the toilet flush by the pull member 20 which is connected with the plunger 15 is possible. This pull connection for activating the toilet flush is independent from the specific flush system and the structure of the toilet.

Figure 9:
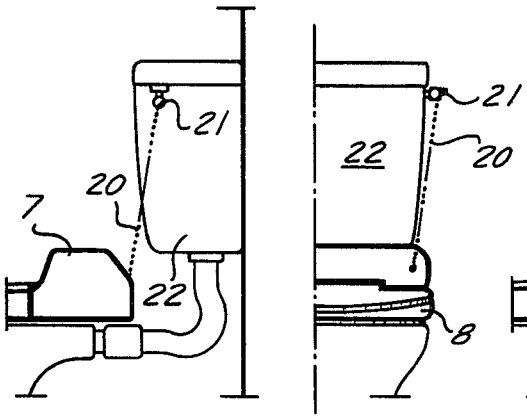
FIG. 9 is a side and partially front view illustrating the connection for a conjoined actuation of the bottom douche and of the toilet flush in case of a toilet having a low level tank.

FIG. 9 shows the connection of a chain 20 which is fastened at one end to the plunger 15 and on the other hand to the pushbutton or lever 21 of a low level toilet tank.

Figure 10:
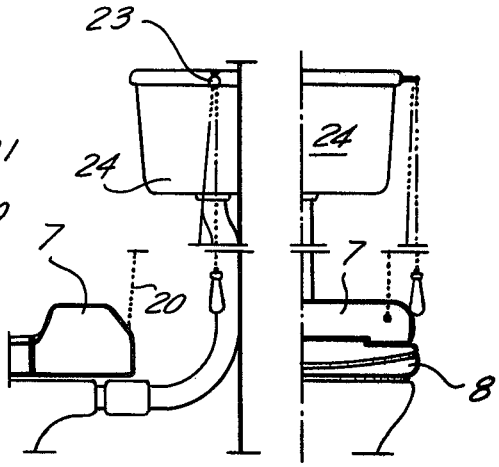
FIG. 10 is a similar view as FIG. 9 in case of a toilet with high level flush tank.

FIG. 10 shows the connection of the chain 20 with an actuating lever 23 of a high level toilet tank 24.

Figure 11:
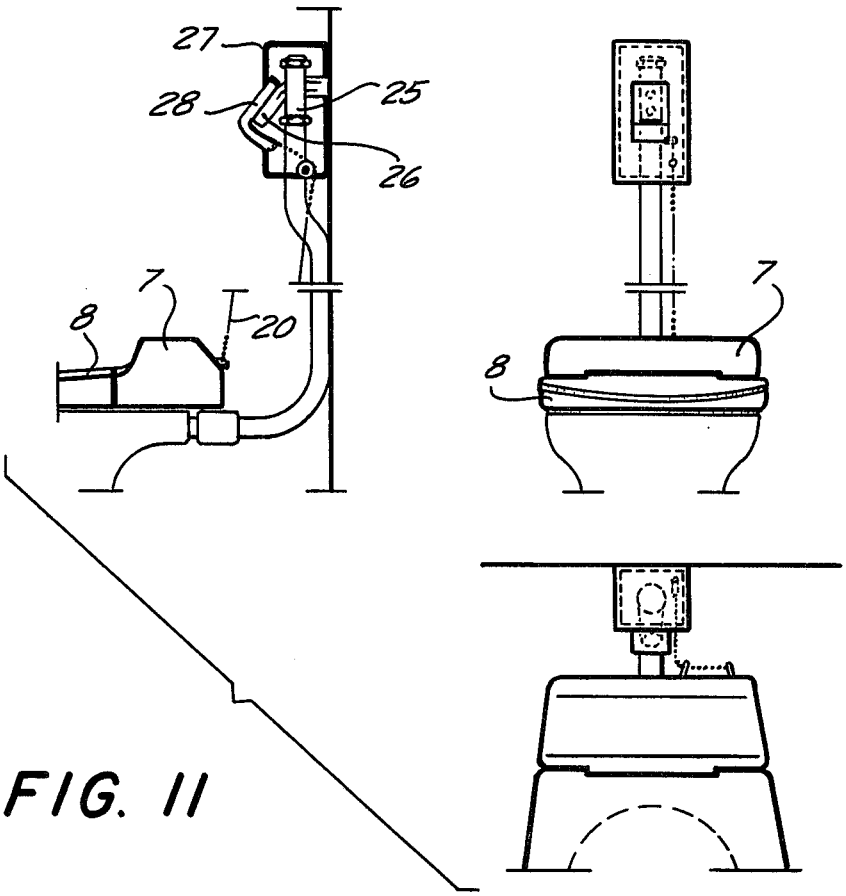
FIG. 11 is a side, front and partial plan view illustrating the connection for joint actuation of the bottom douche and toilet flush.

FIG. 11 finally illustrates a push flush 25 plus an actuating lever 26. A tank 27 which is placed on the lever 26 and is provided with an angle lever 28 to which the chain 20 is connected causes the activation of the flush of the toilet upon movement of the handle lever 5.

The advantage of these devices resides particularly in the fact that all conventional handle means and actuating means are preserved so that the subsequent installing of the device of the invention does not cause any particular difficulties.

The water supply to the nozzles 1 and 2 via the connecting tubing 29 (FIGS. 5 and 6) and the control valve is not further shown since such valves are conventional and their specific form would not be affected by the structure of the invention. Likewise, the simultaneous use of hot air blowers for drying purposes after the use of the bottom douche has not been illustrated since they also are well known in the prior art. Their form would not be influenced by the use of the present invention.

It will be understood that each of the elements described above, or two or more together, may also find a useful application in other types of equipment differing from the types described above.

While the invention has been illustrated and described as embodied in a bottom douche for flush toilets, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A bottom douche for flush toilets comprising opposed arms, one for each side of the toilet, and each arm being supported with one of its ends on the toilet; oppositely disposed, spaced, inwardly and upwardly slanting spray nozzles carried at the free ends of said arms; duct means for passing water through said arms to said nozzles; a handle provided on the toilet, and a linkage connecting said handle and said arms, the said linkage including a rack-and-pinion drive attached to the toilet seat and linking said handle to said arm and nozzles and said rack-and-pinion drive causing the arms to swivel about a horizontal transversal axis by rolling of the said pinion means upon the said rack means, and which linkage further includes a slide surface supporting the pinion means forwardly of said rack means whereby the pinion means after revolving on said rack means exercises a shifting movement in horizontal direction by sliding on said slide surface under the action of said handle.

2. The bottom douche of claim 1 wherein the range of said swiveling and shifting movements is such as to cause the spray to impinge upon the body of a female user of the toilet at the area from the upper end of the buttocks fold to the outlet of the urethra.

3. The bottom douche of claim 1 wherein the rack-and-pinion drive includes at least one stationary rack, one movable rack and a plurality of pinions, the teeth of at least some of the pinions being adapted to mesh with both the stationary and movable.

4. The bottom douche of claim 1 which includes a swivel arm pivoted on the toilet seat and forming part of said handle; a crank portion extending from the pivot and rotatable by vertical movement of said swivel arm and handle; an operative connection between said crank portion and said slide support whereby rotation of the crank upon actuation of the handle causes the slide support and the pinion held thereon to move parallel to the stationary rack; and spring means associated with said toilet seat and acting counter to the movement of said operative connection.

5. The bottom douche of claim 1 which includes an operative connection between said handle means and the flush mechanism of said toilet.

6. The bottom douche of claim 1 wherein said nozzles are directed to cause the water emanating from said nozzles to impinge upon the body of the user from opposite sides at an angle of at least 45°.

7. The bottom douche of claim 1 wherein said rack-and-pinion drive includes a separate stationary rack on each side of the toilet and a plurality of pinions for movement on said rack, racks.

8. The bottom douche of claim 1 wherein the linkage includes a central plunger supported by the toilet seat and movable parallel to said racks, the said plunger being operatively connected with said handle and at least one of said pinions so as to cause the pinions to move in response to movement of said handle.

9. The bottom douche of claim 1 wherein the linkage comprises at least one stationary rack (9), attached to the toilet seat;

a slide support (17) movable parallel to said racks in response to movement of said handle means;

a first pinion (12) held by said slide support for free rotation thereon;

a first movable rack (10) supported on the toilet seat for movement parallel to said stationary rack;

at least one second pinion (13) supported on said first movable rack for freely revolving thereon;

at least one second movable rack (11) supported on said toilet seat for movement parallel to said stationary rack;

a third pinion (14) supported on said second movable rack for freely revolving thereon, a slide surface (18) provided forwardly of said stationary rack (9), the third pinion being operatively connected with the spray arms (3) and having gear teeth on only part of its circumference, the said first pinion supported by the slide support adapted to engage the stationary rack and the first movable rack, the second pinion supported by the first movable rack adapted to engage the stationary rack and the second movable rack and the third pinion supported on said second movable rack adapted to engage with its toothed surface the stationary rack and to slide on said slide surface (18).

10. The bottom douche of claim 1 including spring means adapted to be tensioned by movement of said spray arms so as to move the arms back into initial position after completion of their movement.

11. The bottom douche of claim 10 wherein the spring means are in the form of a spiral spring connected at one end to a stationary part of the toilet seat and at the other end to said partly toothed third pinion.

12. The bottom douche of claim 9 wherein the portion of the circumference of said third pinion which is free of gear teeth has a diameter at most equal to the root line of said gear teeth.

13. The bottom douche of claim 9 which includes a spring adapted to be tensioned by movement of said arms so as to move the arms back into the initial position after completion of their movement and wherein the connection of said spring to said third pinion embraces part of the circumference of the latter pinion.

* * * * *

UNITED STATES PATENT AND TRADEMARK OFFICE

CERTIFICATE OF CORRECTION

PATENT NO. : 4,094,018

DATED : June 13, 1978

INVENTOR(S) : Johannes Benthin

It is certified that error appears in the above-identified patent and that said Letters Patent are hereby corrected as shown below:

[19] Directly beneath "United States Patent" the name of the inventor should read -- Benthin --.

[75] The name of the inventor should read -- Johannes Benthin --.

Signed and Sealed this

*Fifth* Day of *December 1978*

[SEAL]

*Attest:*

RUTH C. MASON
*Attesting Officer*

DONALD W. BANNER
*Commissioner of Patents and Trademarks*